United States Patent [19]

Reiling et al.

[11] 4,361,981

[45] Dec. 7, 1982

[54] TOY MAKE-UP CENTER

[75] Inventors: Walter S. Reiling, Livingston, N.J.; Kwok W. Tsui; Johnny S. C. Yuen, both of Hong Kong, Hong Kong

[73] Assignee: Arco Industries Ltd., Hong Kong, Hong Kong

[21] Appl. No.: 268,777

[22] Filed: Jun. 1, 1981

[51] Int. Cl.[3] ..... A63H 33/26

[52] U.S. Cl. ..... 46/228; 362/136; 362/156

[58] Field of Search ..... 46/228, 229, 226, 227, 46/11, 116, 1 R; 132/79 F, 79 G; 362/135, 136, 154, 155, 156

[56] References Cited

U.S. PATENT DOCUMENTS

| | | | |
|---|---|---|---|
| 1,930,244 | 10/1933 | Lewinsohn et al. | 362/129 |
| 2,487,883 | 11/1949 | Le Baron | 132/80 A |
| 3,048,941 | 8/1962 | Shaw | 46/116 |
| 3,381,120 | 4/1968 | Fleisher et al. | 362/136 |
| 3,384,977 | 5/1968 | Rosenberg | 34/90 |
| 3,603,322 | 9/1971 | Wilson | 132/79 F |
| 4,084,085 | 4/1978 | Kim | 362/156 X |
| 4,269,206 | 5/1981 | Boyd | 132/79 F |

FOREIGN PATENT DOCUMENTS

| | | | |
|---|---|---|---|
| 485272 | 5/1938 | United Kingdom | 362/154 |

*Primary Examiner*—Mickey Yu

*Attorney, Agent, or Firm*—C. Hercus Just

[57] ABSTRACT

A case having a hinged top supporting a mirror and battery-powered lighting structure including rows of at least three transparent bulbous globes along opposite side edges of the mirror, a single electric bulb adjacent each row of globes, a reflector positioned opposite each globe and rearward of the bulb and adapted to reflect light from the single bulb into each row of globes and commonly through all of the globes to illuminate said mirror from opposite edges, the case having a compartment in which a doll head with a wig and a base is storable in horizontal position in the compartment and is mountable in upright position upon support mechanism in the case selectively to face the mirror when the top is vertical or the front of the case. Batteries are positioned in another compartment in the case and an electric circuit connects the batteries to the electric bulbs and a switch in the circuit together with an outlet socket into which a plug on an electric cord to a small imitation hair dryer is connectable to drive an electric motor and fan in the small housing of the dryer.

12 Claims, 6 Drawing Figures

Fig. 2
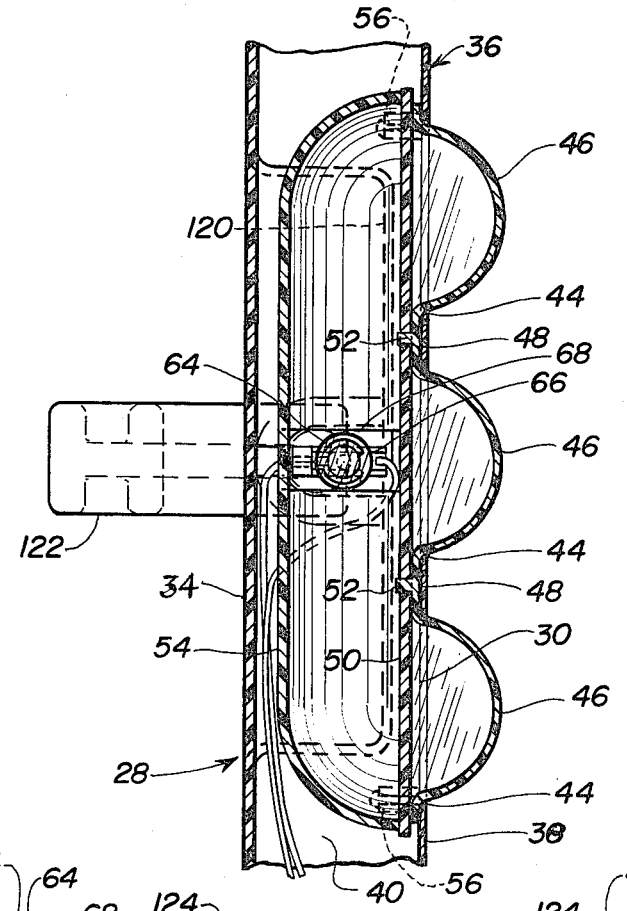
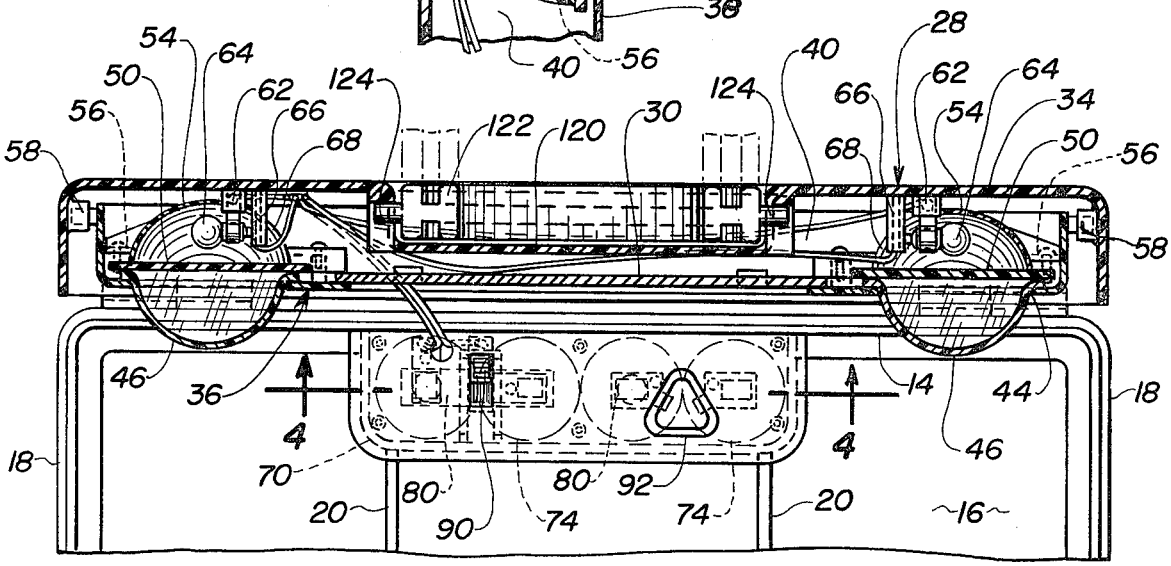
Fig. 3

TOY MAKE-UP CENTER

BACKGROUND OF THE INVENTION

Young children have always been interested in imitating the actions of adults, especially in their play. In this regard, little girls, in particular, are interested in imitating their feminine oldsters in regard to beauty preparations and the present invention pertains to a toy make-up center, in particular to enable little girls or other children to imitate certain beauty operations, such as by employing the head of a doll having a wig suitable to imitate certain hair manipulations, as well as facial beautification of themselves or a doll head.

The present invention also is in kit form enclosed in a case resembling an overnight case with certain features similar to overnight bags employing cases adapted for adult use and including a mirror and illumination means. Cases of the latter type have been developed heretofore and typical examples of these are illustrated in the following U.S. Patent:

U.S. Pat. No. 1,930,244—Lewinshon et al.—Oct. 10, 1933

U.S. Pat. No. 2,487,883—Le Baron—Nov. 15, 1949

U.S. Pat. No. 3,381,120—Fleisher et al.—Apr. 30, 1968

U.S. Pat. No. 3,384,977—Rosenberg—May 28, 1968

In addition to such prior art, which primarily is concerned with mirrors and illumination in a traveling case or otherwise, there also has been prior activity in playthings, including a doll head used in one form of beauty preparation, namely, hairwashing, and such a device comprises the subject matter of U.S. Pat. No. 3,048,941 to Shaw, dated Aug. 14, 1962.

The present invention is provided with innovations not found in any of the prior art, notwithstanding the fact that it employs a case having a mirror, illumination means for the mirror and a doll head, details of which are set forth below.

SUMMARY OF THE INVENTION

It is among the more important objects of the present invention to provide a box-like case, somewhat resembling an overnight case, having a top hingedly connected to the back edge of the box and a compartment is provided in said box which is of sufficient size to readily accommodate a doll head having a flat base adapted to be supported in operative position upon complementary means within the box to support the head in upright position, the top of the box also having a mirror and illuminating means energized by batteries supported in the case and a row of at least three transparent bulbous globe members being supported in said top respectively along each side edge of the mirror and a single electric light bulb is mounted rearwardly of each row of globes adjacent the center globe of each row, whereby an elongated reflector behind each row of globes and said single electric light bulb therefor is arranged to reflect light from said single bulb into all of the globes of the row with which it is associated to give the appearance of each globe having an electric light bulb behind it and thereby provide adequate illumination for the mirror while minimizing electric battery requirements.

It is another object of the invention to provide within the box support means which are parallel to the upper edges of the box to receive at least spaced portions of the base of the doll head to support the same in upright position with the face thereof disposed toward the mirror or said head may be reversed for the face to extend away from the mirror adjacent the front wall of the box so that the operator may directly view the face of the doll for beauty operations.

It is a further object of the invention ancillary to the foregoing to provide said support means within the box in the form of spaced ribs extending upwardly from the bottom of the box and the flat base of the doll head having means at opposite edges engageable with and positionable upon the upper edges of said ribs to provide positioning support for the doll head with respect to the mirror in the manner stated above.

Still another object of the invention is to provide the top of the box in the form of a first shell having limited depth and the lighting equipment and mirror being supported in a second shell of less depth than the first shell and supported within the first shell by pivot means along one edge to permit tilting of the second shell relative to the first shell to dispose the second shell forwardly to permit access to the light bulbs for servicing, and screw means secure the opposite edge or the second shell to the first shell.

A still further object of the invention is to provide the aforementioned reflector means in the nature of interrelated reflecting compartments respectively behind each globe and the bulb and such interrelation being such as to disburse the light from the bulb adequately and substantially evenly to all of said globes in the row thereof with which the bulb is associated by means of a diffusing sheet.

Still another object of the invention is to include a toy imitation hair dryer, including a small housing, enclosing a small electric motor and fan to blow air from one end of the housing, and also having an electric cord extending from the opposite end of the housing with an electric plug thereon, the top of the box also having an electric outlet socket connected in the electric circuit of the bulbs and batteries and said cord on the dryer having a plug complementary with the outlet socket and connectable therewith for operation of the motor and fan by said batteries.

Details of the foregoing objects and of the invention, as well as other objects thereof, are set forth in the following specification and illustrated in the accompanying drawings comprising a part thereof.

BRIEF DESCRIPTION OF THE DRAWINGS

FIG. 2 is a fragmentary vertical sectional view, showing a portion of the contents of the cover and illustrating part of the illuminating means for the case, as seen on the line 2—2 of FIG. 1.

FIG. 3 is a fragmentary horizontal sectional view, showing further details of the hinged top and the contents thereof, as well as a part of the contents of the case, as seen on the line 3—3 of FIG. 1.

DETAILED DESCRIPTION OF THE PREFERRED EMBODIMENT

Figure 1:
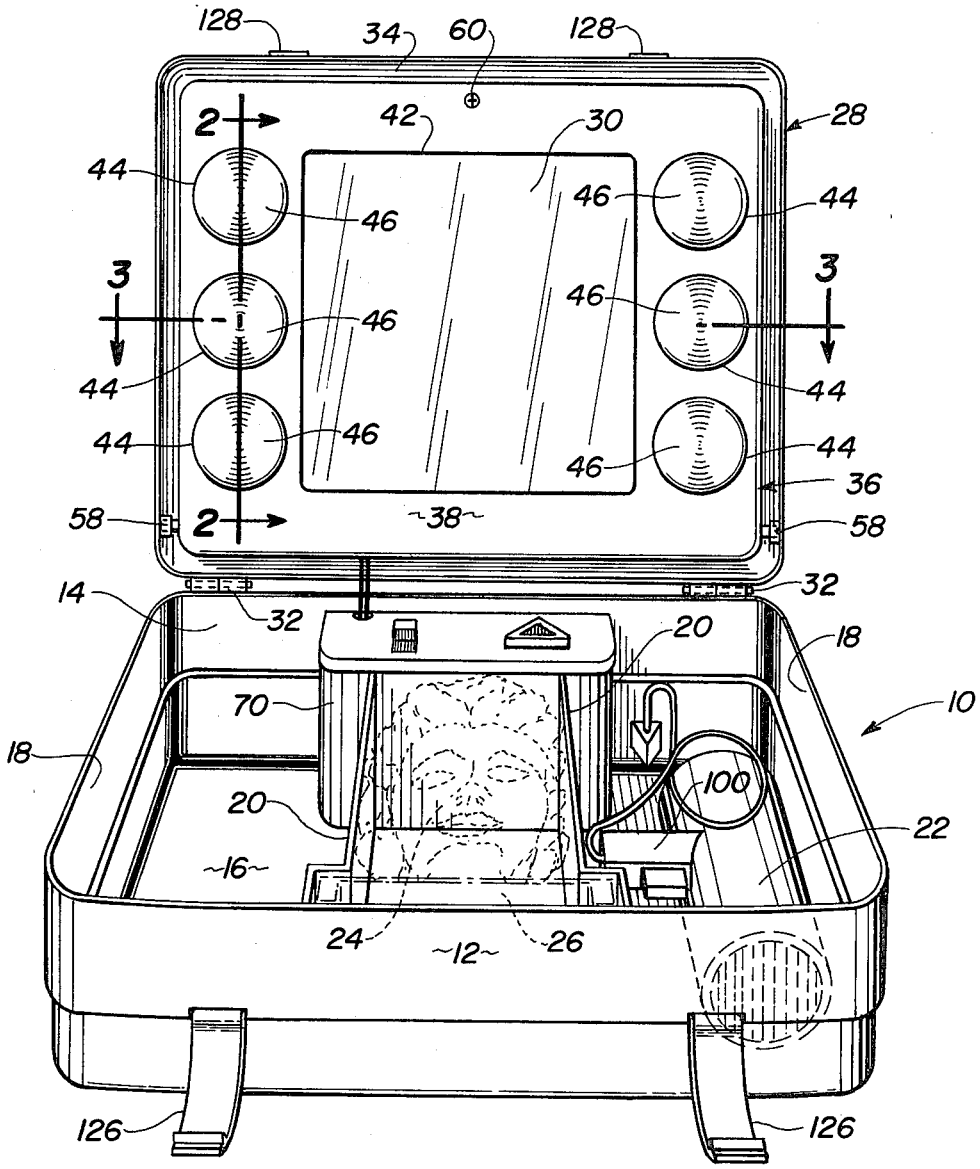
FIG. 1 is a front perspective view of a toy make-up center comprising a case having a hinged top and showing the top in open, substantially vertical position with the case, and illustrating in phantom, a head of a doll which may be used with the make-up center.

Referring particularly to FIG. 1, there is illustrated therein a substantially rectangular box-like case 10 having a front 12, back 14, bottom 16, and sides 18, all of which preferably are formed integrally by molding the same from suitable synthetic resin of a rigid nature. Also formed integrally with the case 10 are interior, parallel webs or walls 20, which divide the case 10 into a plurality of compartments respectively adapted to contain toy-type beautician accouterments, such as hair curlers, in the left-hand compartment, for example, as viewed in FIG. 1, and in the right-hand compartment, a toy hair dryer 22 is capable of being stored until ready for use. Further, the central compartment between the walls 20 is adapted to contain the head of a doll 24, shown in phantom, mounted upon a transverse base 26 which, for example, may be supported upon the upper edges of the walls 20 by extending between the same to support the head in upright position, either facing the hinged top 28 and the mirror 30 therein, or facing away from the same.

The combined case 10 and top 28, which are connected by hinges 32, resemble a so-called over-night case of adult-type, except that this toy version preferably is of a smaller size, but nevertheless, is readily capable of a child, such as a small girl, playing either as a beauty operator or administering to her own face and head in play manner.

For purposes of rendering the toy make-up center more realistically to a child, the top 28 not only is provided with the mirror 30 and the same is illuminated by the following mechanism and devices. Referring to FIGS. 2 and 3, in particular, it will be seen especially from FIG. 3 that the top 28 comprises an outer flat top shell 34 and an inner second flat shell 36 nested in inverted manner within the top shell 34 so that the bottom 38 thereof is outermost and parallel to the upper panel of the top 28 but spaced therefrom to provide accommodations for illuminating means for the mirror 30 within the space 40.

In view of the fact that while the illuminating means provided by the invention is powered by a limited number of dry cell batteries, it is desired that the life of said batteries be as long as possible and this is accomplished by utilizing a minimum number of electric lamp bulbs but providing an illusion of a much greater number of said bulbs through reflecting means of a novel type. Referring to FIG. 1, it will be seen that the bottom 38 of the second flat shell 36, which is outermost as viewed in said figure, is provided with a relatively square opening 42 immediately behind which the mirror 30 is supported by means to be described. The bottom 38 also is provided along opposite sides of the opening 42 with rows of three holes 44 through which complementary bulbous globes 46 project, which are substantially hemispherical and are integrally molded to each other, as best shown in FIG. 2, and are provided with connecting members 48 within the plane of the rims of said globes 46. The connected globes also have opposite end flanges within said plane, as shown in FIG. 2, which are disposed between the second shell 36 and a light-diffusing panel or strip 50, and preferably projections 52 are formed on the connecting members 48 for extension through aligned holes in the diffusing panels 50 for positioning purposes, as shown in FIG. 2.

One of the most important features of the present invention comprises the molded reflector 54, which, as seen in FIG. 2, is rounded at the opposite ends and subtends the entire row of three bulbous globes 46. In cross-section, as shown in FIG. 3, the reflectors 54 are substantially semi-circular and the rounded opposite ends are somewhat quadrants of a hemisphere and the rims of the reflectors 54 are within a common plane abutting the inner surface of the diffusing panels 50, as also well shown in FIG. 2. For purposes of securing the reflector 54 to the unitary rows of bulbous globes 46 and the light-diffusing panels 50, each reflector 54 adjacent opposite ends thereof is provided with a lateral lug 56 through which suitable screws extend and are threaded into short bosses on the inner surfaces of the second flat shell 36, as best seen in FIGS. 2 and 3.

From FIGS. 1 and 3, it will be seen that adjacent portions of the side flanges of the top shell 34 and second shell 36 are adjacent each other and for purposes of connecting the two shells together, interengaging socket and stud means 58 are provided adjacent the hinged edge of top 28, whereby the second shell 36 may be hingedly moved with respect to the top shell 34. It is desirable to have the interconnected shells separable for purposes of servicing the lighting structure, but for purposes of securing the same in operative position, a screw 60, see FIG. 1, extends through the second shell 36 and is screwed into a suitable stud on the inner surface of the top shell 34. Although the bulbous globes 46, reflectors 54 and diffusing panels 50 are supported by the second flat shell 36, it is preferred that the electric bulbs be supported by the top 28, as shown best in FIG. 3, in the form of studs 62, which are molded integrally with the inner surface of the top shell 34, said studs having spring clips to engage the base of the bulbs 64, and additional studs 66, also intgral with the inner surfaces of the second shell 36 support contacts for the tips of the base of the bulbs and to which one wire of electric circuitry is connected, while a second wire is connected to the spring clip supported by studs 62 that support the bulbs, thereby establishing a circuit to and from each bulb.

From FIG. 2, it will be seen that the bulb 64, of which only a single one is provided for each row of the three bulbous globes 46 is positioned opposite the intermediate globe 46 and extends through a suitable notch 68 in one side of the reflector in order that the bulb may remain supported by the top shell 34 when the second shell 36 is removed for purposes of exposing the bulb, such as for servicing. The important feature can best be visualized from FIG. 2, namely, that a single bulb 64 is capable of illuminating the entire plurality of each row of bulbous globes 46 by the light therefrom not only showing through the intermediate globe 46 but, being reflected by the inner-reflecting wall of the elongated reflector 54 to the remaining globes 46 respectively adjacent opposite ends of the row thereof and thereby minimizing the consumption of power supplied by a limited number of dry cell batteries described hereinafter. Equalizing of the light transmitted to each of the globes 46 also is facilitated by the inclusion of the elongated diffusing panel 50 extending across the rims of all of the globes 46, and comprising a frosted sheet.

Figure 4:
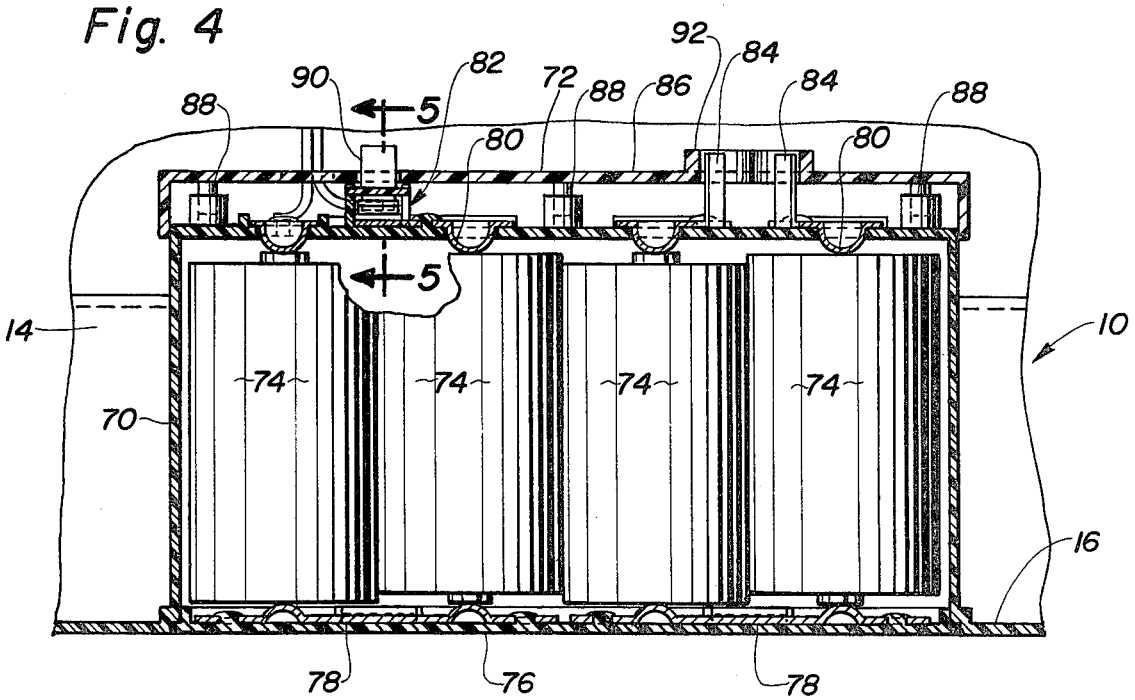
FIG. 4 is a fragmentary vertical sectional view, taken on the line 4—4 of FIG. 3, and illustrating details of the compartment in which the batteries are contained, together with a switch and socket contact means.

For purposes of providing current to the bulb 64, referring to FIGS. 1, 3 and 4, it will be seen that the case 10 also includes a battery compartment 70, which is generally rectangular, as can be seen from the plan view in FIG. 3, and the end walls thereof are preferably molded integrally with the back 14 of the case 10. Compartment 70 also has a horizontal top 72 integral therewith and the bottom of the compartment 70 is open for purposes of insertion of the batteries 74 thereinto, but said open bottom being closed by a removable cover 76 to which contact strips 78 are attached integrally, the same preferably being of an elastic nature, as are the additional contacts 80 on top 72 of said compartment. The top 72 of compartment 70 also supports a switch 82, as well as a pair of contacts 84, comprising a socket to which a plug on an electric conduit for an applicance, such as the blower for the hair dryer 22, may be connected. To protect the circuitry on top of the batteries 74, a supplementary top cover 86 of insulating nature is secured fixedly to the top of compartment 70, such as by interfitting pairs of studs and sockets 88, which may be secured together by cement, if desired. Actuating member 90 of switch 82 extends through an opening in the supplementary top cover 86 and the same also provides a socket-defining wall 92 of predetermined geometric shape, as shown in FIG. 3, for association with the contacts 84. The drawings illustrate various wiring members, especially in FIGS. 2–4, and it is to be understood that said wiring is of conventional nature, whereby detailed explanation thereof is not believed to be necessary.

Figure 5:
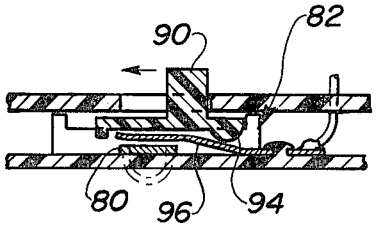
FIG. 5 is a fragmentary vertical sectional view of the switch means shown in FIG. 4, as seen on the line 5—5 thereof.

Referring to FIG. 5, details of the switch 82 are illustrated in vertical section, and it will be seen that a cam member 94 affixed to the actuating slide 90 engages a spring leaf contact 96 to depress the same against contact 80, illustrated in FIG. 5, when moved to the left as indicated by the arrow shown in said figure, and return movement of member 90 permits the contacts 80 and 96 to separate.

Figure 6:
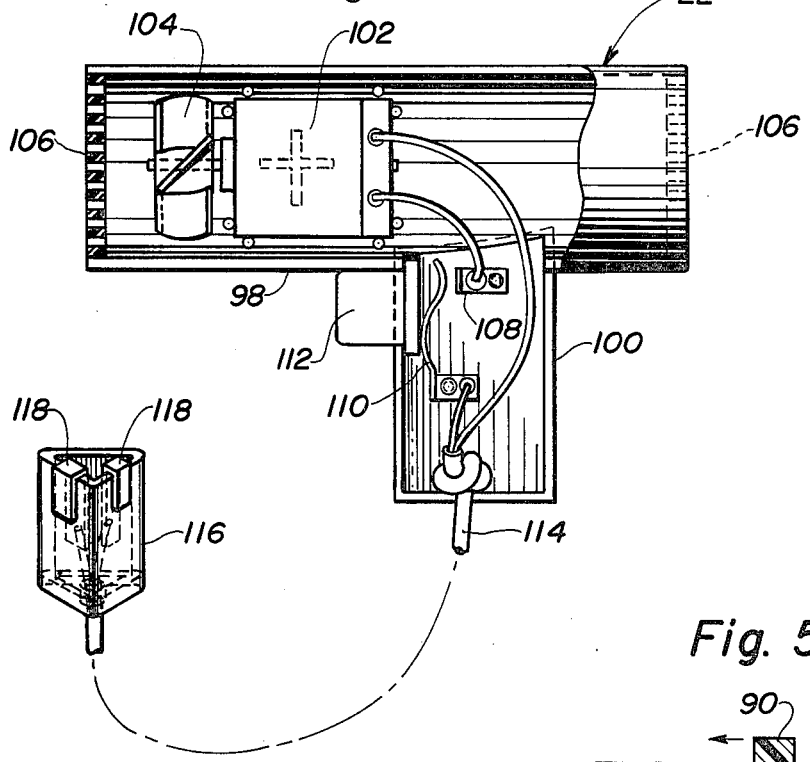
FIG. 6 is a toy hair dryer of a blower type comprising a substantially T-shaped housing, partly broken away to illustrate details therein and also illustrating in perspective a preferred type of electric plug adapted to engage the contact means shown in FIG. 4.

Referring to FIG. 6, an exemplary toy hair dryer 22 is illustrated having a cylindrical casing 98 from which a handle member 100 extends. A small low-powered miniature electric motor 102 is supported within the casing 98 and has a fan 104 fixed to the motor shaft. Opposite ends of the casing 98 are provided with perforated diaphragms 106 through one of which air is drawn by the fan 104 and it is discharged at the opposite end. Circuitry to the motor includes a fixed contact 108 of a switch including flexible contact 110, which is operated by finger-engageable plunger 112, operated by a child incident to playing with the hair dryer 22. Electric conduit 114 extends to a plug 116 of complementary shape to the socket-defining wall 92 in the supplementary top cover 86 of the battery housing for engagement with the contacts 84 therein, the plug 116 having contacts 118 thereon for such connection.

Further to add reality to the toy make-up center, the top 28 is provided in the upper flat member thereof with a molded recess 120, see FIGS. 2 and 3, within which a U-shaped handle 122 is adapted to be folded by pivoting the same about its pintles 124 disposed in sockets formed in the opposite ends of the walls defining the recess 120, as clearly shown in FIG. 3. The handle may be disposed within the recess 120 by fitting it in either direction and the case 10 also is provided with appropriate clasps 126, shown in FIG. 1, which engage complementary latching members 128 formed on top 28, as also shown in FIG. 1. When the top 28 is secured in closed position, the case may be carried by means of the handle 122 when extended to upright position, as in FIG. 2.

Wherever possible, it is intended and proposed that the components forming the toy make-up center shall be molded from suitable plastic material, not only for purposes of presenting an attractive exterior appearance, but also affording easy assembly and accuracy of components, and otherwise providing a toy capable of affording considerable enjoyment to young children, especially young girls.

The foregoing description illustrated preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A toy make-up center comprising a box-like case having a front and back, a flat shell-like top of limited depth hingedly connected at one edge to the back edge of said box, a limited number of compartments in said case adapted to contain beautician accouterments, a second flat shell interfitted in inverted manner within said top shell with the bottom thereof outermost, a mirror supported centrally upon the outer surface of said second shell, said top being adapted to be moved to vertical position perpendicular to the plane of the top of said case to expose one of said compartments which is along the back of said case to support batteries therein, a row of at least three transparent bulbous globe members in said second shell along each side edge of said mirror, a single electric light bulb mounted in said second shell rearwardly of each row of globes and adjacent the center globe of each row thereof, an elongated reflector behind each row of said globes and said electric light bulb therefor, each reflector having interconnected reflecting surfaces respectively behind each globe and said bulb thereby being adapted to reflect light from said single bulb into the surface behind each globe and simultaneously through all of said globes to give the appearance of a separate bulb behind each globe in said rows to illuminate said mirror, and an electric circuit rearwardly of said mirror connecting said batteries and bulbs and including a switch to control lighting of said bulbs to illuminate said mirror from the opposite side edges.

2. The toy according to claim 1 in which a light-diffusing panel is disposed between said light bulbs and said bulbous globe members.

3. The toy according to claim 2 in which said light-diffusing panel comprises a translucent elongated panel extending along each row of bulbous globe members.

4. The toy according to claim 3 further characterized by said rows of bulbous globe members being molded separately from said second shell in unitary rows and said second shell having rows of opening complementary to the base portions of said globe members and receiving the same to project through said openings, and means securing said reflectors and diffusing panels and unitary rows of bulbous globe members commonly to said second shell member.

5. The toy according to claim 4 in which said second shell member also is provided with another opening between said rows of openings commensurate in size with said mirror, said mirror being separate from said second shell and secured thereto rearwardly of said another opening by said means which secure said reflectors and unitary rows of bulbous globe members to said second shell member.

6. The toy according to claim 2 in which said top shell has support means for said light bulbs fixed thereto independently of said second shell.

7. The toy according to claim 1 in which the sides of said top and second shells are closely adjacent each other and further including pivot means between the sides of said second shell and top shell adjacent the back rim of said top shell to permit limited pivoting of said second shell away from said top shell to provide access to said bulbs for servicing, and means to secure the adjacent opposite portions of said shells detachably until servicing of the bulbs is required.

8. The toy according to claim 7 in which means to secure the adjacent opposite portions of said shells detachably comprises screw means extending through said second shell and into said top shell.

9. The toy according to claim 1 in which said one of said compartments is generally rectangular and including a top and end and front walls integral with each other and with said back of said case, the bottom of said one compartment being open to receive a row of dry cell batteries therethrough and being closed by a removable cover co-planar with the bottom of said case, and the top of said one compartment also supporting said switch for the circuit between said batteries and lamp bulbs.

10. The toy according to claim 9 in which said circuit also includes socket contacts interconnected therein and supported by said top of said one compartment for connection of other electrical instruments within said circuit.

11. The toy according to claim 10 further including in combination therewith a toy imitation hair dryer comprising a tubular housing enclosing a low-power electric motor having a fan connected to the shaft thereof and powered by said dry cell batteries in said one compartment, air discharge openings in one end of said housing, and an electric cord connected to said motor and having an electric plug on the outer end thereof interfitting said socket contacts on the top of said one compartment.

12. The toy according to claim 11 further including a handle on said tubular housing extending laterally therefrom and supporting an electric switch having a depressable switch actuator and connected in circuit with said electric cord.

* * * * *